US011471009B2

(12) United States Patent
Chang

(10) Patent No.: US 11,471,009 B2
(45) Date of Patent: Oct. 18, 2022

(54) PAPER DISPENSER

(71) Applicant: FANER AROMA PRODUCT CO., LTD., Guangzhou (CN)

(72) Inventor: Hsu-Hui Chang, New Taipei (TW)

(73) Assignee: FANER AROMA PRODUCT CO., LTD., Guangzhou (CN)

( * ) Notice: Subject to any disclaimer, the term of this patent is extended or adjusted under 35 U.S.C. 154(b) by 0 days.

(21) Appl. No.: 17/146,520

(22) Filed: Jan. 12, 2021

(65) Prior Publication Data

US 2021/0127910 A1 May 6, 2021

Related U.S. Application Data

(63) Continuation-in-part of application No. 16/362,739, filed on Mar. 25, 2019, now abandoned.

(51) Int. Cl.
*A47K 10/36* (2006.01)

(52) U.S. Cl.
CPC .... *A47K 10/3625* (2013.01); *A47K 2010/365* (2013.01)

(58) Field of Classification Search
CPC .. B65H 35/00; B65H 35/0006; B65H 35/006; B65H 35/0066; B65H 35/0073; B65H 35/008; B65H 35/0086; B65H 35/0093; B65H 35/04; B65H 35/06; B65H 35/08; B65H 35/10; B65H 16/005; B65H 16/02; B65H 16/025; B65H 16/06; B65H 16/08; A47K 10/32; A47K 10/34; A47K 10/36; A47K 10/3606; A47K 10/3612; A47K 10/3618; A47K 10/3625; A47K 10/38; A47K 2010/3233; A47K 2010/3693
See application file for complete search history.

(56) References Cited

U.S. PATENT DOCUMENTS 4,375,189 A 3/1983 Berner
4,882,568 A * 11/1989 Kyser ..... G08B 21/18 242/563.2

(Continued)

FOREIGN PATENT DOCUMENTS

EP 3549499 A1 * 10/2019 ..... A47K 10/36

OTHER PUBLICATIONS

Non-Final Office Action dated Jun. 30, 2020 for U.S. Appl. No. 16/362,739.

(Continued)

*Primary Examiner* — Evan H MacFarlane
(74) *Attorney, Agent, or Firm* — Schmeiser, Olsen & Watts, LLP

(57) ABSTRACT

A paper dispenser includes a paper input area and a paper output area; the paper input area including a holder for a paper roll and including a paper input unit provided to displace paper from the paper roll towards the paper output area, the paper output area including a paper output unit which is adapted to dispense paper to an outside of the dispenser, the dispenser further including a paper cutting unit arranged between the paper input unit and a paper output unit, which paper cutting unit is adapted for cutting the paper, wherein the paper output unit is operationally connected to the paper input unit to dispense the paper at a dispensing speed that is at least as large as a displacing speed of the paper input unit.

4 Claims, 11 Drawing Sheets

(56) References Cited

U.S. PATENT DOCUMENTS

| | | | | |
|---|---|---|---|---|
| 5,107,734 | A | 4/1992 | Armbruster | |
| 5,695,105 | A | 12/1997 | Ohara | |
| 6,712,253 | B2 * | 3/2004 | Hargrave | G07B 5/02 225/9 |
| 6,736,348 | B1 | 5/2004 | Forman | |
| 6,824,091 | B2 | 11/2004 | Inana | |
| 7,040,566 | B1 | 5/2006 | Rodrian | |
| 7,398,944 | B2 * | 7/2008 | Lewis | A47K 10/36 250/221 |
| 7,783,380 | B2 * | 8/2010 | York | A47K 10/3662 700/231 |
| 7,998,050 | B2 | 8/2011 | De Matteis | |
| 9,999,326 | B2 * | 6/2018 | Borke | A47K 10/3625 |
| 10,201,256 | B2 * | 2/2019 | Chang | A47K 10/38 |
| 10,362,909 | B2 * | 7/2019 | Chang | A47K 10/3637 |
| 10,966,578 | B2 * | 4/2021 | Zimmermann | A47K 10/405 |
| 2001/0001475 | A1 | 5/2001 | Formon | |
| 2001/0034263 | A1 | 10/2001 | Roberts | |
| 2002/0030061 | A1 | 3/2002 | Forman | |
| 2002/0100785 | A1 | 8/2002 | Roberts | |
| 2003/0167893 | A1 | 9/2003 | Morris | |
| 2004/0178298 | A1 * | 9/2004 | Kennard | B65H 16/02 242/570 |
| 2006/0169827 | A1 | 8/2006 | Lewis | |
| 2007/0194166 | A1 * | 8/2007 | Reinsel | A47K 10/36 242/563 |
| 2011/0308451 | A1 | 12/2011 | Kaufmann | |
| 2013/0079923 | A1 | 3/2013 | Cittadino | |
| 2014/0001303 | A1 | 1/2014 | Tramontina | |
| 2016/0353945 | A1 | 12/2016 | Osborne, Jr. | |
| 2016/0353947 | A1 | 12/2016 | Osborne, Jr. | |
| 2017/0042390 | A1 | 2/2017 | Rubenson | |
| 2017/0055787 | A1 | 3/2017 | Barke | |
| 2017/0290473 | A1 | 10/2017 | Barke | |
| 2018/0263433 | A1 | 9/2018 | Osborne, Jr. | |
| 2019/0075980 | A1 | 3/2019 | Xu | |
| 2020/0029750 | A1 | 1/2020 | Zimmermann | |
| 2021/0032063 | A1 * | 2/2021 | Janek | A47K 10/3687 |

OTHER PUBLICATIONS

Final Office Action dated Oct. 13, 2020 for U.S. Appl. No. 16/362,739.

* cited by examiner

PAPER DISPENSER

CROSS-REFERENCE TO RELATED APPLICATION

This application is a continuation-in-part patent application of U.S. application Ser. No. 16/362,739 filed on Mar. 25, 2019, the entire contents of which are hereby incorporated by reference for which priority is claimed under 35 U.S.C. § 120.

BACKGROUND OF THE INVENTION

1. Field of the Invention

The present invention relates to a paper dispenser with a paper input area and a paper output area, and more particularly, to a paper dispenser for public restrooms. Furthermore, the paper dispenser of the present invention relates to a paper dispenser wherein the paper is fed from a paper roll.

2. Description of the Related Art

Drawbacks of known paper dispensers are related to the amount of paper that is dispensed in one dispensing step. Many paper dispensers lack a mechanism to control the amount of paper dispensed. This leads to excessive use of paper and consequently high maintenance costs of the paper dispenser. Other drawbacks relate to compatibility with different types of paper rolls. The majority of paper dispensers are only suitable for dispensing paper from one type of paper roll. Both the size of the paper roll, including width of the paper roll and thickness of the paper roll is predetermined and significant deviations are not allowed since it cannot be processed by the paper dispenser. Furthermore, the thickness and strength of the paper itself is predetermined. Other drawbacks relate to reliability of the paper dispensers. Many paper dispensers suffer from paper jam issues which affect the uptime of the paper dispenser. Furthermore, it significantly increases the operation costs since an operator is needed to remove the jammed paper and restore the operating mode of the paper dispenser.

BRIEF SUMMARY OF THE INVENTION

It is an object of the present invention to provide a paper dispenser that solves at least one, preferably multiple, most preferably all of the above mentioned drawbacks.

To this end the invention provides a paper dispenser comprising a paper input area and a paper output area; the paper input area comprising a holder for a paper roll and comprising a paper input unit provided to displace paper from the paper roll towards the paper output area, the paper output area comprising a paper output unit which is adapted to dispense paper to an outside of the dispenser, the dispenser further comprising a paper cutting unit arranged between the paper input unit and a paper output unit, which paper cutting unit is adapted for cutting the paper, wherein the paper output unit is operationally connected to the paper input unit to dispense the paper at a dispensing speed that is at least as large as a displacing speed of the paper input unit.

The paper dispenser of the invention is provided with a paper input unit and a paper output unit. Between the paper input unit and the paper output unit, a paper cutting unit is provided. The paper is cut by the paper cutting unit so that the dispensed amount of paper is controllable. The paper input area comprises a paper roll and a paper input unit. The paper input unit displaces paper from the paper roll towards the paper output area. The paper output area comprises a paper dispensing unit which dispenses the paper to an outside of the paper dispenser. There, a user can grab the dispensed paper and use the paper, for example to clean or dry his/her hands.

To optimize the throughput and minimize paper jams, a certain tension is preferably applied to the paper between the paper input unit and the paper output unit. This tension significantly simplifies the cutting of the paper via the paper cutting unit. This tension is obtained by relating the dispensing speed of the paper output unit with the displacing speed of the paper input unit. In practice, the dispensing speed is at least as large as the displacing speed. Preferably, the dispensing speed is slightly larger than the displacing speed such that the paper output unit pulls (harder) on the paper than the paper input unit. Paper under tension can be cut easily so that jams as a result of miscutting the paper are avoided.

Preferably the holder comprises at least one slot and at least one plug adapted to be received in the at least one slot, the paper dispenser further comprising a paper roll which is compatible with at least one plug to be connected thereto in such a manner that the paper roll is connectable to the holder via the at least one plug. Since a plug is provided as an intermediate between the paper roll and the holder, a simple technical set-up is obtained that allows to connect paper rolls with different widths in the holder. Since the paper roll is not directly connected to the holder, different types and sorts of paper roll can be connected to the holder via different plugs or via plugs that are shaped to allow connection with different paper rolls.

Preferably, the slot and plug have a compatible shape allowing the plug to fit in the slot in at least two positions. For example one position relates to a paper roll with a first width, while a second position relates to a paper roll with a second width which is smaller than the first width. The plug being able to be fitted in the slot in at least two positions allows a single plug to be used to connect paper rolls with different shapes and properties to the holder. Thereby, the paper dispenser can also be formed to fit the plug at different heights or at different positions with respect to the holder to allow paper rolls with a larger diameter to be fitted in a preferred position in the paper dispenser.

Preferably, the plug comprises a first segment and a second segment, wherein the first segment is adapted for connecting to the paper roll, and wherein the second segment comprises the compatible shape. The first segment connects to the paper roll, for example by sliding at least a part of the first segment into a hollow shaft of the paper roll. Alternatively, connection means are provided that are compatible with connection means at the paper roll to connect the paper roll with the plug. The second segment of the plug is adapted for connecting to the slot, as described above, in multiple positions with respect to the slot.

Preferably, the plug is formed about a longitudinal axis, wherein the compatible shape allows the plug to be fitted in the slot in a first position along the longitudinal axis and at a second position located at a first distance from the first position. The first distance is being measured along the longitudinal axis. This allows the plug to connect paper rolls with different distances to the holder by positioning the plug in the different positions along the longitudinal axis. Further preferably, the first segment has a protrusion to engage the paper roll over a second distance that is at least larger than the first distance. Due to the protrusion engaging the paper roll, the plug and paper roll can be interconnected with different relative positions, depending on how deep the protrusion engages the paper roll. Since it is able to engage the paper roll over the second distance, the range to connect the paper roll and the plug stretches over this second distance. Because this second distance is larger than the first distance, relating to the different positions with respect to the slot, the paper roll should not have a predetermined distance to be able to be fitted in the holder. Depending on the width of the paper roll, the plug engages with the protrusion in the paper roll and is fitted in a slot that optimally corresponds to the width of the paper roll. This will be further explained in the detailed description and with reference to the figures.

Preferably, the holder is symmetrical and comprises two opposing slots and two plugs. The symmetrical shape allows the roll to be mounted in a central part of the paper dispenser. Furthermore, by providing two slots and two plugs opposing each other, the range of different widths of the paper roll that can be mounted in the paper dispenser increases or is even doubled.

Preferably, the paper input is adapted to allow a slip of the paper in the unit and wherein the dispensing speed is larger than the displacing speed. The technical choice to make the dispensing speed larger than the displacing speed ensures that a tension is applied to the paper between the paper input unit and the paper output unit. However, a tension that is too large could tear the paper. Therefore, the paper input unit is adapted to allow a slip of the paper in the unit. When the tension would increase above a predetermined tension, the paper slips so that the tension can be controlled and unwanted tearing of the paper is avoided. Thereby, further preferably, the resistance against slip of the paper in the paper input unit is lower than the resistance against slip of the paper in the paper output unit.

Preferably, a sensor is provided in the paper dispenser to measure the length of the paper dispensed. In this context, further preferably the paper cutting unit is operated based on the sensor. This allows controlling the amount of paper dispensed by the paper dispenser in a dispensing step.

Preferably, the paper cutting unit comprises a blade mounted on a shaft so that the blade is moveable, by rotation of a shaft from a retracted position to a paper cutting position. The shaft is further preferably controllable to control the moment of cutting of the paper in the process. This allows to control the amount of dispensed paper.

Further preferably, the shaft with blade is replaceable. By replacing the shaft and the blade, different types of blades can be inserted in the paper dispenser which allows the paper dispensers to be filled with different types of paper. In this context, it is noted that different types of paper often require different types and shapes of cutting blades for optimally cutting the paper. With this technical set-up, as described above, the paper dispenser is designed for different types of paper rolls, different widths of paper rolls and different types of paper without significant amendments of the paper dispenser.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE INVENTION

Figure 1:
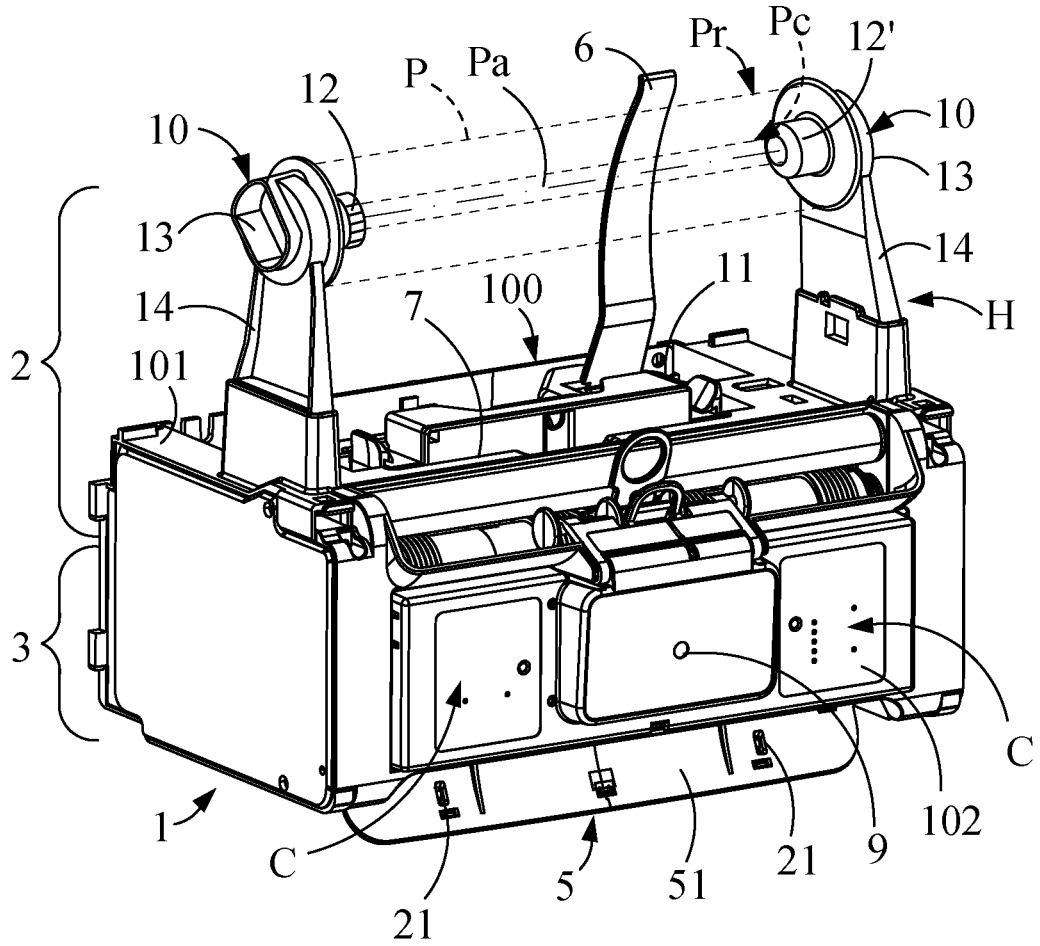
FIG. 1 illustrates a preferred embodiment of the paper dispenser.
Figure 1A:
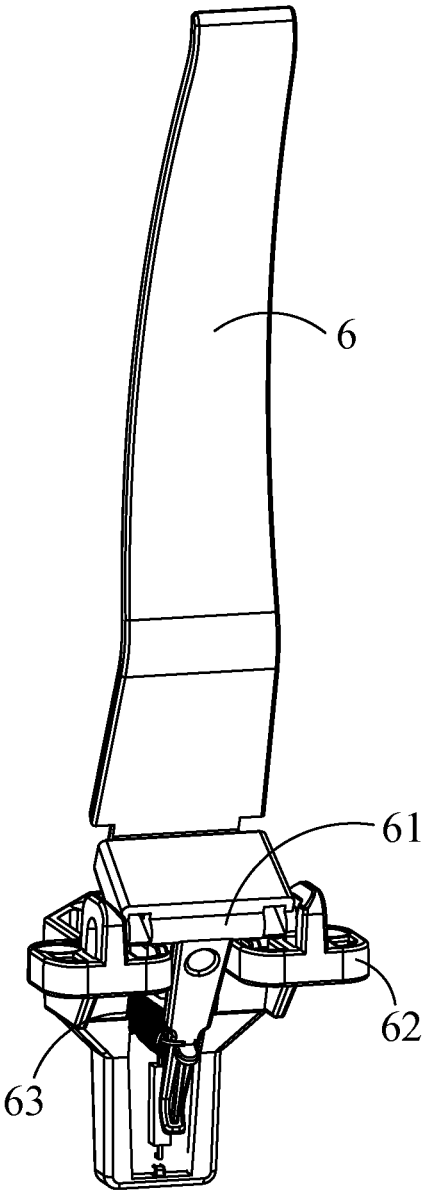
FIG. 1A illustrates the detection lever of FIG. 1.
Figure 1B:
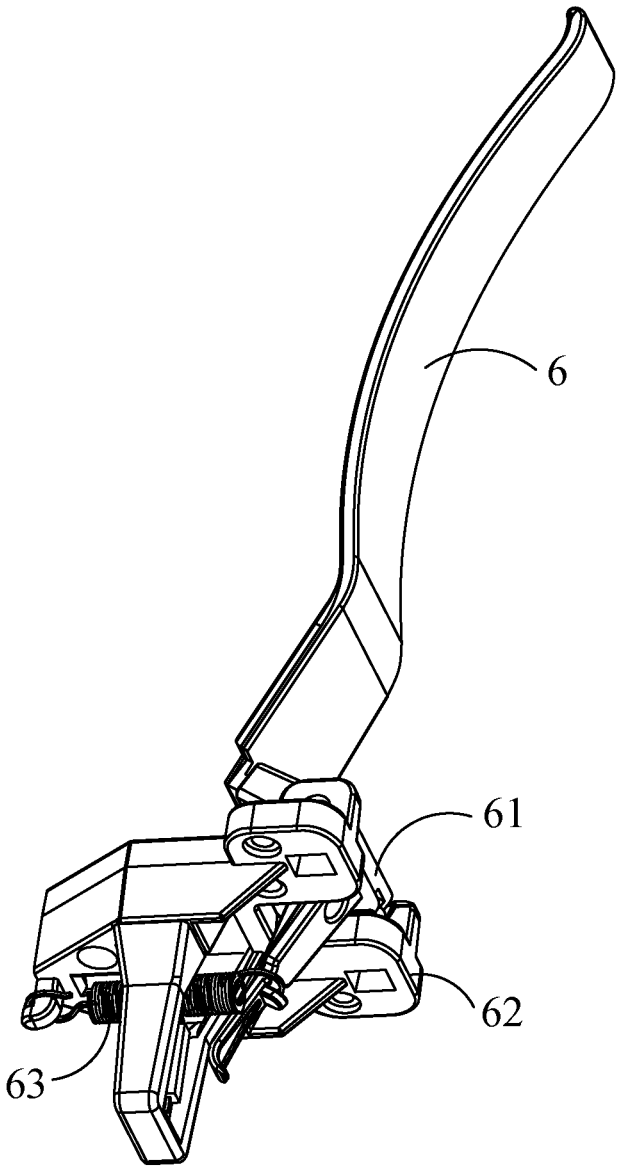
FIG. 1B illustrates the detection lever of FIG. 1.

The present invention will now be described with some preferred embodiments thereof and by referring to the accompanying drawings.

FIGS. 1, 1A, 1B and 7 show a paper dispenser 1 according to a preferred embodiment of the invention. The upper part of the paper dispenser 1 comprises a paper input area 2, and the lower part of the paper dispenser 1 comprises a paper output area 3. The paper input area 2 has two segments. The upper segment of the paper input area 2 comprises a holder H for holding a paper roll Pr. The holder H will be described in further detail with reference to FIGS. 2, 2A and 2B. Preferably, a detection lever 6 is provided, which is elastically loaded to lean against the outer periphery of the paper roll Pr in the holder H. The detection lever 6 has a seat 62 and a spring 63. The seat 62 is disposed in an assembling hole 11 of the paper dispenser 1. The detection lever 6 is protruded from the assembling hole 11. A pivot 61 of the detection lever 6 is pivotally connected to the seat 62. The pivot 61 defines an axis, and the axis is between an upper part of the detection lever 6 and a lower part of the detection lever 6. The spring 63 is connected to the seat 62 and the lower part of the detection lever 6. The upper part of the detection lever 6 is elastically loaded to lean against the outer periphery of the paper roll Pr. The paper roll Pr according to the invention typically comprises a cylindrical central core Pc, around which paper P is rolled. This paper P typically forms a continuous sheet of paper having a width that corresponds to the width of the paper roll Pr. Since the paper P is continuous, it has to be cut to dispense a predetermined amount of paper. The mechanism to cut the paper P is described hereunder. When the paper P of the paper roller Pr decreases, the spring 63 pulls the lower part of the detection lever 6 to make the upper part of the detection lever 6 closing to the cylindrical central core Pc of the paper roller Pr. Therefore, an amount of remaining paper in the paper dispenser 1 can be detected via the detection lever 6.

The lower segment of the paper input area 2 comprises a paper input unit 4. The primary function of the paper input unit 4 is to transfer the paper P from the paper roll Pr towards the paper output area 3. The paper input unit 4 comprises paper stopper rollers 8. The paper stopper rollers 8 are adapted to stop the throughput of paper through the paper input unit 4. The paper input unit 4 further comprises a set of rollers and a set of gears to drive the rollers, as well as a motor, which are described hereunder with reference to further figures.

The paper output area 3 comprises a paper output unit 5. In FIG. 1, a paper dispensing guide 51 is shown, the paper dispensing guide 51 is a part of the paper output area 3. The paper output unit 5 further comprises a set of rollers and corresponding gears to drive the rollers connected to a motor, for dispensing paper to an outer side of the dispensing unit 1. These elements are described in more detail hereunder. The primary function of the paper output unit 5 is to dispense paper to an outer side of the dispensing unit 1, where a user can grab the paper. The paper is received from the paper input unit 4. FIG. 1 further shows a sensor 9 which in the embodiment of FIG. 1 is formed as a field or an area which is touch sensitive. Via the sensor 9, operation of the paper dispenser 1 can be triggered. The paper dispenser 1 can be configured to perform one or a predetermined number of paper dispensing steps after input is received from the sensor 9. The skilled person will realize that the sensor 9 is only an embodiment, and other types of sensors, for example a push button, can be equally used.

Figure 2:
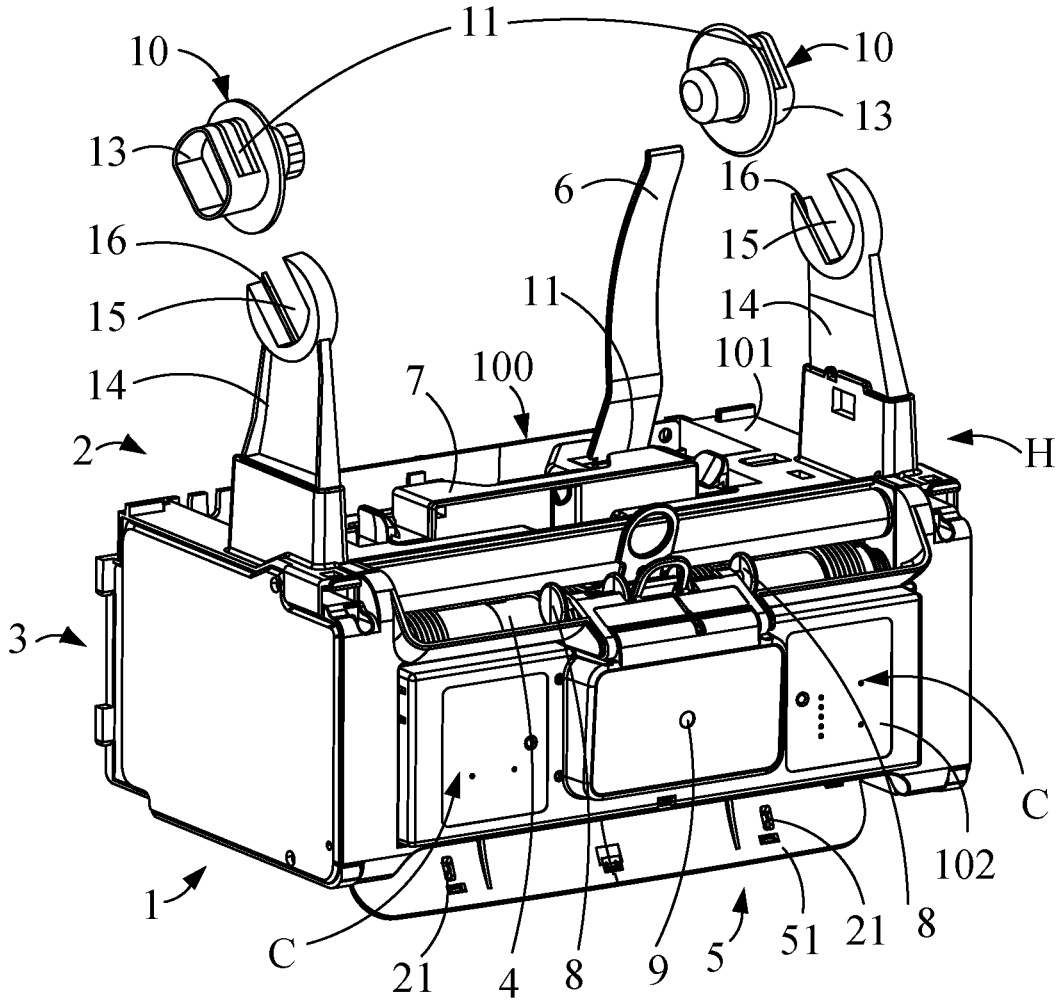
FIG. 2 illustrates the paper dispenser of FIG. 1 in a partially exploded view.
Figure 2A:
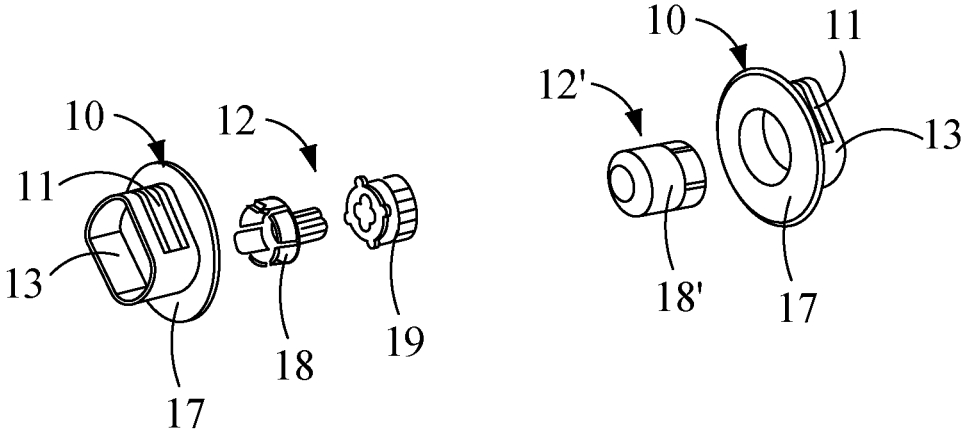
FIG. 2A illustrates plugs of FIG. 2 in a partially exploded view.
Figure 2B:
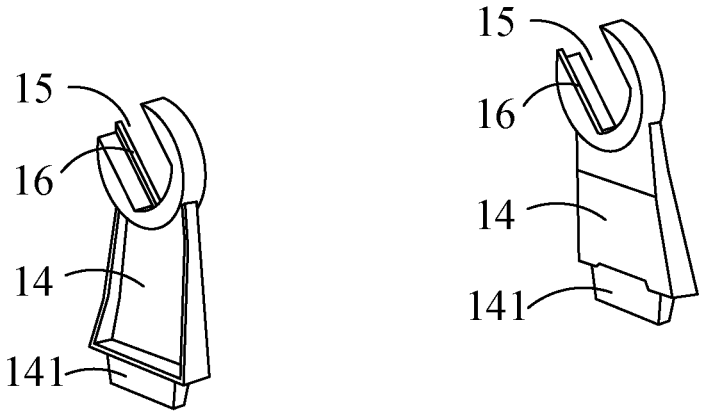
FIG. 2B illustrates arms of FIG. 2.

FIGS. 2, 2A and 2B show a detailed embodiment of the upper part of the paper input area 2 of the paper dispenser 1 of FIG. 1. This upper part comprises the holder H for the paper roll (not shown). The holder H is formed by two arms 14 that extend upward from a main body 101 of the paper dispenser 1. These arms 14 are preferably replaceable. To this end, the arms 14 comprise a snap fit connection 141 that is compatible with the main body 101 of the paper dispenser 1, such that the arms 14 can be connected and disconnected from the paper dispenser 1. This allows the paper dispenser 1 to be provided with different types of arms 14. Arms 14 can have different lengths, different slots 15, or different shapes, for example an S shape to bring the slots 15, at the distal end of the arms 14, closer to each other.

In the embodiment of FIGS. 1, 2, 2A and 2B, arms 14 are straight and extend upward from the main body 101 of the paper dispenser 1. The arms 14 are provided with slots 15 which are U shaped to receive a plug 10 with a compatible shape. In the U shaped slot 15, a rail 16 is provided that fits in a groove 11 at the plug 10. Via the rail 16 and groove 11, the plug 10 can be positioned in the slot 15. In the embodiment of FIGS. 1, 2, 2A and 2B, the plug 10 comprises multiple grooves 11, in particular three grooves 11, which are provided at a distance of each other. This allows the plug 10 to be connected in the slot 15 at multiple, in particular three different positions. These different positions enable an operator to vary the distance between one plug 10 and an opposing plug 10. Varying this distance allows to mount paper rolls having different roll lengths (measured in the direction of the center axis Pa of the paper roll Pr) in the paper dispenser 1 without the necessity of adapting the paper roll Pr, using different plugs 10 or changing the arms 14.

The plug 10 comprises two segments. A first segment 12 comprises protrusions which are provided to engage with a paper roll. Typically the center core of the paper roll is hollow, so that a round, typically cylindrical, optionally tapered protrusion is sufficient as the first segment 12 to mount the paper roll in the paper dispenser 1. Alternatively, the first segment 12 comprises clamp means (not shown) which correspond to compatible connecting means (not shown) at the paper roll for connecting the plug 10 to the paper roll. The first segment 12 is preferably separated from a second segment 13 by a collar, as is shown in the FIG. 2A. The second segment 13 comprises the grooves 11. The skilled person will understand that the groove-rail connection can be reversed so that the second segment 13 is provided with one or multiple rails while the slot 15 is provided with the groove or grooves.

In the embodiment of FIG. 2A, an exploded view is shown of the plugs 10. In this embodiment, each second segment 13 comprises a main body 17 with a collar and each first segment 12, 12' comprises a paper roll core 18, 18'. Each paper roll core 18, 18' is preferably changeable or replaceable so that different paper roll cores corresponding to different types of paper rolls can be connected in each main body 17. The paper roll core 18 could interconnect with a proprietary plug of the core of the paper roll, shown as element 19. This proprietary plug 19 can be a fixed part of the paper roll, or can be adapted to optimally engage with the paper roll. The set-up described above allows to interconnect different types of paper rolls in an optimal manner to the paper dispenser 1. The multiple elements described above are interchangeable so that only minimal adaptations are necessary to connect a paper roll of a different type.

Figure 3:
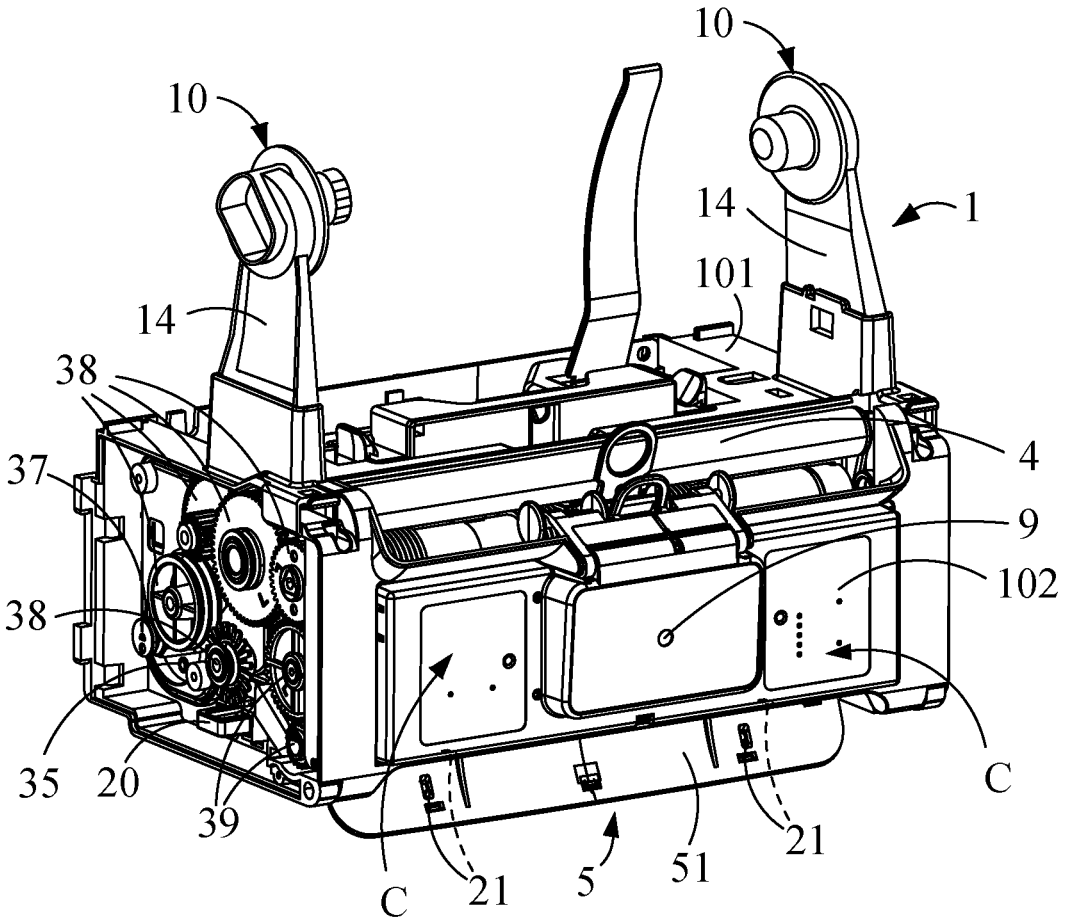
FIG. 3 illustrates the paper dispenser of FIG. 1 with an opened left side.
Figure 4:
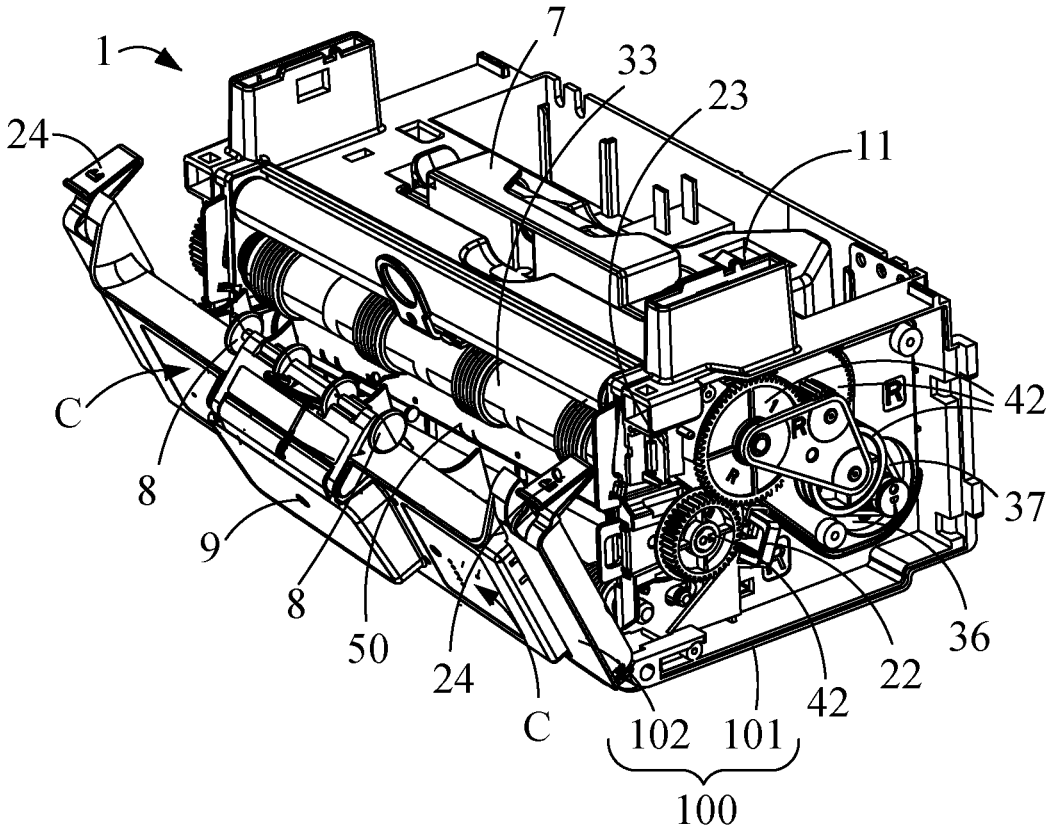
FIG. 4 illustrates the paper dispenser of FIG. 1 with an opened right side and a partially opened front side.
Figure 5:
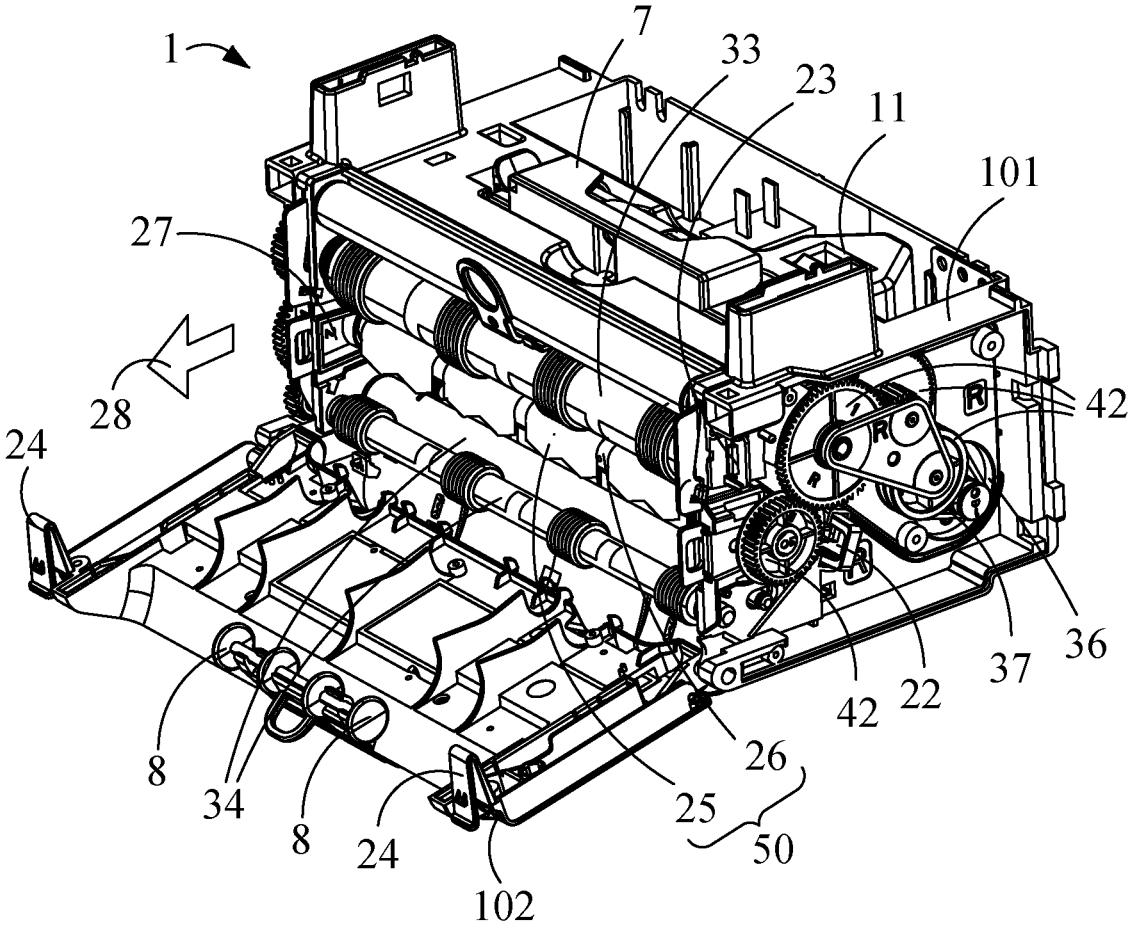
FIG. 5 illustrates the paper dispenser of FIG. 1 wherein the cutting mechanism is highlighted.
Figure 6:
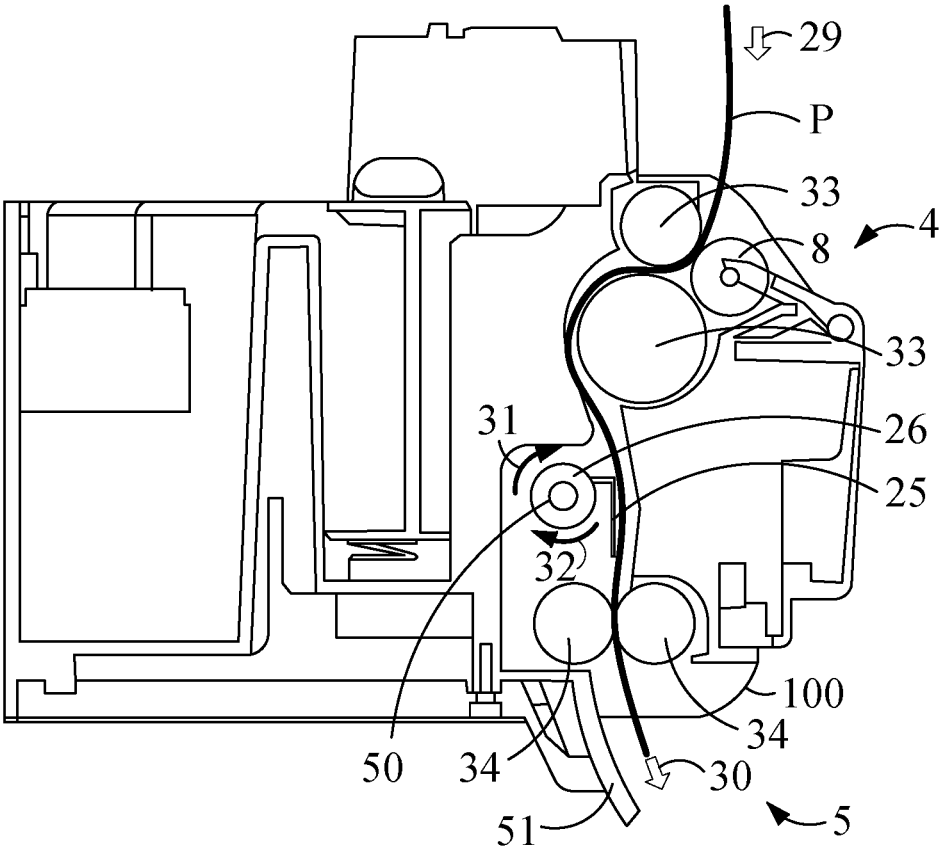
FIG. 6 illustrates a schematic cross-section of a paper dispenser of an embodiment of the invention.

FIG. 3 shows the paper dispenser 1 wherein the left side of the paper dispenser 1 is open to reveal the elements driving the paper through the paper dispenser 1. A paper driving motor 35 which is connected to multiple gears that drive the paper input unit 4 and the paper output unit 5 will be described further below. FIG. 3 further illustrates a sensor 20 to control the length of the dispensed piece of paper. Between the paper input unit 4 and the paper output unit 5, a paper cutting unit 50 (as shown in FIGS. 4-6) is provided, which is described in greater detail hereunder. The sensor 20 is adapted to measure the length of the amount of paper that is dispensed by the paper output unit 5. This measurement can be used in a processor to control the paper input unit 4 and paper output unit 5 as well as to control the paper cutting unit 50, such that a predetermined amount of paper, or a predetermined length of paper, is dispensed in one dispensing step. In the embodiment of FIG. 3, the sensor 20 is formed as an infrared sensor that measures the rotation of one of the rollers of the paper output unit 5. The skilled person will understand that other types of sensors can be used to measure the amount of paper dispensed.

FIG. 3 further shows cut of type infrared sensors 21 at a dispensing opening of the paper output unit 5. Via these sensors 21, removal of the piece of dispenses paper can be detected so that, upon receipt of an input via the sensor 9, a successive dispensing step can be started. When the sensors 21 detect that the paper has not been removed yet, such successive dispensing step can be delayed or blocked.

FIGS. 4~5 show the paper dispenser with an opened right hand side. Furthermore, in FIGS. 4-5 the front cover 102 of the paper dispenser 1 is partly removed from the main body 101. This front cover 102 comprises multiple releasable clamps 24 which are compatible with the main body 101, so that the front cover 102 can be removed from the paper dispenser 1. This opens the paper dispenser 1. The primary reason for opening the paper dispenser 1 is to replace the paper cutting unit 50, as will be further described hereunder. The main body 101 of the paper dispenser 1 comprises a front cover safety switch 23. The front cover safety switch 23 is disposed in front of the main body 101 to contact the front cover 102. The front cover safety switch 23 detects removal of the front cover 102 such that the operation of the paper dispenser 1 can be stopped. This improves that safety of the paper dispenser 1. In the paper dispenser 1, the paper cutting unit 50 is provided which could harm to a user opening the front cover 102 when the paper dispenser 1 is in an operating mode. Via the front cover safety switch 23, the paper dispenser 1 is set to a maintenance mode wherein uncontrolled or unwanted movement or elements in the paper dispenser 1 is prevented.

As shown in FIGS. 3-5 and 7-8, the paper dispenser 1 comprises controller C, the controller C is electrically connected to the sensor 9, the sensor 20, the sensor 21, the paper driving motor 35, a blade driving motor 36, the paper stopper rollers 8 and the front cover safety switch 23 by wires (not shown), the paper driving motor 35 drives input rollers 33 and output rollers 34. The blade driving motor 36 drives a shaft 26 carrying at least one blade 25. A cross-section of the at least one blade 25 is L-shaped. When the front cover safety switch 23 is triggered, the controller C control the paper driving motor 35 and the blade driving motor 36 to stop.

Figure 7:
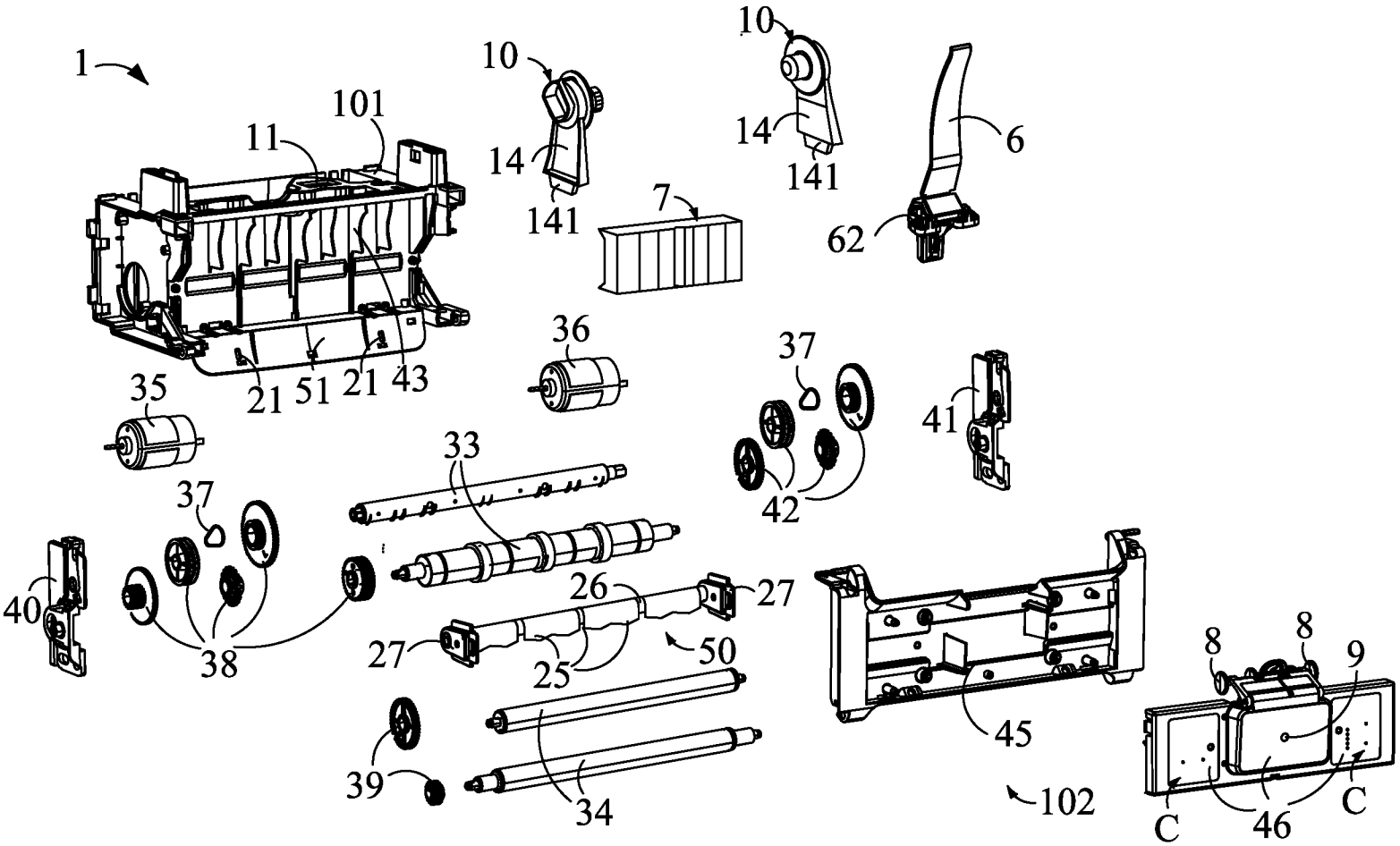
FIG. 7 illustrates an exploded view of the paper dispenser of FIG. 1.

As shown in FIGS. 4-5 and 7, a housing 100 of the paper dispenser 1 has the main body 101 and the front cover 102. One side of the front cover 102 is hinged to the main body 101, and another side of the front cover 102 is engaged with the main body 101 by the quick release clamps 24. When the said another side of the front cover 102 is released from the main body 101, the front cover safety switch 23 is triggered, and the controller C control the paper driving motor 35 and the blade driving motor 36 to stop.

Figure 8:
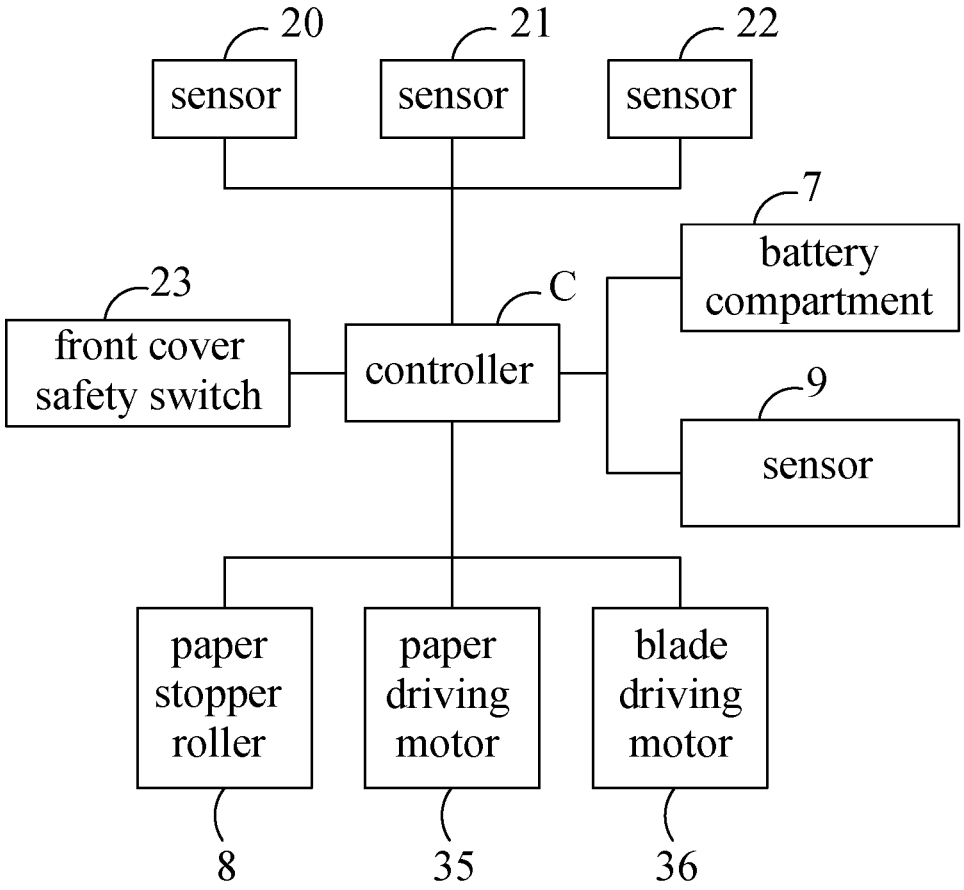
FIG. 8 illustrates a preferred embodiment of the controller.

FIGS. 4-5 and 7 further show the blade driving motor 36 connected via a number of gears to the shaft 26 carrying the blades 25 for cutting the paper, which will be described hereunder. FIGS. 4-5 and 8 further show a sensor 22 electrically connected to the controller C by wire (not shown) for detecting the position of the blade 25. The sensor 22 preferably is an infrared sensor connected to the shaft 26 of the paper cutting unit 50. The sensor output can be used by the controller C to control the cutting of the paper. As described above, this allows to control the length or amount of paper which is dispensed in one dispensing step.

FIG. 5 shows the paper cutting unit 50. The paper cutting unit 50 comprises a shaft 26 and one or multiple blades 25 that are provided on a periphery of the shaft 26. The blades 25 are preferably mounted tangential with respect to the shaft 26. The shape of the blades 25 is preferably optimized to cut paper. Depending on the type of paper that is dispensed by the dispenser, the blade 25 can have different shapes. In the shown embodiment, the blades do not extend over the complete width of the paper, but are placed to only cut the paper over a predetermined percentage of the width, preferably at least 70%, more preferably at least 80% of the width of the paper. This allows a piece of paper to be partly separated from the paper roll so that a user can remove the piece of paper from the paper roll with minimum effort. Since the paper is already partly cut, tearing the piece of paper from the paper roll by tearing the remaining part of the width of the paper is easy. Furthermore, not completely cutting the paper simplifies the throughput of paper through the paper dispenser 1.

The shaft 26 and blade or blades 25 are preferably provided on a connector 27. Most preferably, two connectors 27 are provided at opposing ends of the shaft 26 so that the paper cutting unit 50 formed by the connectors 27, the shaft 26 and the blade 25 can be removably connected to the main body 101 of the paper dispenser. Removing the paper cutting unit 50 is illustrated by arrow 28 in FIG. 5. By making the paper cutting unit 50 replaceable, not only paper dispenser is simplified, but it also allows the paper dispenser to be used with different types of paper. As described above, different types of paper may require different types of cutter blades to optimally cut the paper. The cutting blades can be easily switched by replacing the paper cutting unit.

FIG. 6 shows a schematic cross section of the paper dispenser, and shows from top to bottom how the paper is input along an input path 29 into the paper input unit 4. The input path 29 comes from a paper roll which is not shown in this figure. This paper is input into paper input unit 4 having multiple input rollers 33. The input rollers 33 displace the paper from the paper roll towards the paper output unit 5. Paper output unit 5 comprises multiple output rollers 34. Between the paper input unit 4 and the paper output unit 5, the paper cutting unit 50 is provided. The paper cutting unit 50 is formed by the shaft 26 and the cutting blade 25.

FIG. 6 illustrates how the cutting blade 25 can be retracted by a retracting rotation 32. The figure also shows how the paper can be cut by a cutting rotation 31. The skilled person will understand that by controlling the paper input unit 4, the paper output unit 5 and the paper cutting unit 50, the length of the pieces of paper that are dispensed at the output can be controlled. The output is illustrated by an output path 30. Preferably, to optimize the operation of the paper cutting unit 50, a tension is maintained on the paper between the paper input unit 4 and the paper output unit 5. This tension can be maintained by controlling the paper throughput speed of the paper input unit 4 with respect to the paper output unit 5. In particular, the paper output unit 5 preferably has a slightly higher throughput than the paper input unit 4 such that the paper output unit 5 effectively pulls the paper through the paper input unit 4. This pulling results in a tensioning of the paper between the paper input unit 4 and the paper output unit 5. This tension significantly simplifies the cutting of the paper by the blades 25.

The input rollers 33 and the output rollers 34 are preferably driven by the paper driving motor 35 and the gears which are shown in FIGS. 3 and 6-7. The shaft 26 of the paper cutting unit 50 is preferably driven by the blade driving motor 36 and the gears which are shown in FIGS. 4 and 6-7. This allows to independently control the throughput of the paper and the cutting of the paper, which thereby allows to dispense any length or any amount of paper. Thus the operator of the paper dispenser 1 is free to configure the dispenser as he or she wishes.

FIG. 7 shows an exploded via of the paper dispenser 1 according to a preferred embodiment of the invention. The figure shows the main frame 43 of the dispenser, having the paper dispensing guide 51. All other elements are adapted to directly or indirectly connect to the main frame 43 to form the paper dispenser 1. The figure shows the paper driving motor 35 which is connected to a paper input gear set 38 via a belt transmission 37. Via the belt transmission 37, the paper driving motor 35 is further connected to the paper output gear set 39. Using this configuration a single motor 35 can be used to transport the paper through the paper dispenser. The paper input gear set 38 is connected to multiple paper input rollers 33. The sensor 20 measures rotations of one gear of the paper input gear set 38 to measure the length of the amount of paper that is dispensed by the paper output unit 5. Paper output gear set 39 is connected to the paper output rollers 34. The elements are interconnected at the left-hand side via a left fixing plate 40.

FIGS. 4 and 7 further show that blade driving motor 36 which is connected to the blade driving gear set 42 via a belt transmission 37. The blade driving gear set 42 is connected to the shaft 26 carrying the cutting blade 25. The sensor 22 measures rotations of one gear of the blade driving gear set 42. Using this set-up, the shaft 26 and the blade 25 can be driven by the blade driving motor 36. The position of the blade 25 can be detected. The different elements are held together via the right fixing plate 41.

FIG. 7 further shows the replaceable arms 14 adapted for holding the plug 10. Via these plugs 10, a paper roll can be connected to the paper dispenser 1. The thickness of the paper roll is detected via the detection lever 6. Paper dispenser 1 further comprises a battery compartments 7 which provides power to the blade driving motor 36, the paper driving motor 35 and the controllers C. The controllers C are typically integrated in the operation panel 46. The operation panel 46 can be mounted onto a quick release frame 45 to form the front cover 102. The operation panel 46 holds the paper stopper rollers 8.

As shown in FIGS. 1, 3-4 and 6-8, the paper stopper rollers 8 are connected to the operation panel 46 of the front cover 102 and are electrically connected to the controllers C by wires (not shown), and the paper stopper rollers 8 are disposed at a conveying path (including the input path 29 and the output path 30). The input rollers 33 are disposed upstream of the output rollers 34 along the conveying path. The shaft 26 carrying the at least one blade 25 is disposed upstream of the output rollers 34 and is disposed downstream of the input rollers 33 along the conveying path. The sensors 21 are disposed downstream of the output rollers 34 along the conveying path for detecting the paper P of the paper roll Pr, a distribution direction of the sensors 21 is parallel to the center axis A of the paper roll Pr.

The present inventions may be embodied in other specific apparatus and/or methods. The described embodiments are to be considered in all respects as only illustrative and not restrictive. In particular, the scope of the invention is indicated by the appended claims rather than by the description and figures herein. All changes that come within the meaning and range of equivalency of the claims are to be embraced within their scope.

A person of skill in the art would readily recognize that steps of various above described methods can be performed by programmed computers. Herein, some embodiments are also intended to cover program storage devices, e.g., digital data storage media, which are machine or computer readable and encode machine executable or computer-executable programs of instructions, wherein said instructions perform some or all of the steps of said above-described methods. The program storage devices may be, e.g., digital memories, magnetic storage media such as a magnetic disks and magnetic tapes, hard drives, or optically readable digital data storage media. The embodiments are also intended to cover computers programmed to perform said steps of the above-described methods.

The description and drawings merely illustrate the principles of the invention. It will thus be appreciated that those skilled in the art will be able to devise various arrangements that, although not explicitly described or shown herein, embody the principles of the invention and are included within its spirit and scope. Furthermore, all examples recited herein are principally intended expressly to be only for pedagogical purposes to aid the reader in understanding the principles of the invention and the concepts contributed by the inventor(s) to furthering the art, and are to be construed as being without limitation to such specifically recited examples and conditions. Moreover, all statements herein reciting principles, aspects, and embodiments of the invention, as well as specific examples thereof, are intended to encompass equivalents thereof.

The functions of the various elements shown in the FIGs, including any functional blocks labeled as "processors", may be provided through the use of dedicated hardware as well as hardware capable of executing software in association with appropriate software. When provided by a processor, the functions may be provided by a single dedicated processor, by a single shared processor, or by a plurality of individual processors, some of which may be shared. Moreover, explicit use of the term "processor" or "controller" should not be construed to refer exclusively to hardware capable of executing software, and may implicitly include, without limitation, digital signal processor (DSP) hardware, network processor, application specific integrated circuit (ASIC), field programmable gate array (FPGA), read only memory (ROM) for storing software, random access memory (RAM), and non-volatile storage. Other hardware, conventional and/or custom, may also be included. Similarly, any switches shown in the FIGS. are conceptual only. Their function may be carried out through the operation of program logic, through dedicated logic, through the interaction of program control and dedicated logic, or even manually, the particular technique being selectable by the implementer as more specifically understood from the context.

It should be appreciated by those skilled in the art that any block diagrams herein represent conceptual views of illustrative circuitry embodying the principles of the invention. Similarly, it will be appreciated that any flow charts, flow diagrams, state transition diagrams, pseudo code, and the like represent various processes which may be substantially represented in computer readable medium and so executed by a computer or processor, whether or not such computer or processor is explicitly shown.

The present invention has been described with some preferred embodiments thereof and it is understood that the preferred embodiments are only illustrative and not intended to limit the present invention in any way and many changes and modifications in the described embodiments can be carried out without departing from the scope and the spirit of the invention that is intended to be limited only by the appended claims.

What is claimed is:

1. A paper dispenser comprising a paper driving motor, a blade driving motor, input rollers, output rollers, a shaft carrying at least one blade, controllers, sensors, a front cover safety switch, paper stopper rollers, a holder and a housing;

the housing has a main body and a front cover, one side of the front cover is hinged to the main body, and another side of the front cover is engaged with the main body by releasable clamps;

the paper driving motor, the blade driving motor, the input rollers, the output rollers and the shaft carrying the at least one blade are disposed in the main body, the paper driving motor drives the input rollers and the output rollers, the input rollers are disposed upstream of the output rollers along a conveying path; the blade driving motor drives the shaft carrying the at least one blade, a cross section of the at least one blade is L-shaped, the shaft carrying the at least one blade is disposed upstream of the output rollers and is disposed downstream of the input rollers along the conveying path;

the holder is connected to the main body for holding a paper roll and is provided with a detection lever, the detection lever has a pivot, a seat and a spring, the seat is disposed in an assembling hole of the paper dispenser, the pivot having an axis that is between an upper part of the detection lever and a lower part of the detection lever, the pivot is pivotally connected to the seat, the spring is connected to the seat and the lower part of the detection lever, and the upper part of the detection lever is elastically loaded to lean against an outer periphery of the paper roll;

the sensors are disposed downstream of the output rollers along the conveying path for detecting a paper of the paper roll, a distribution direction of the sensors is parallel to a paper roll center axis defined by the holder;

one of the controllers being electrically connected to the paper driving motor, the blade driving motor and the front cover safety switch; the front cover safety switch is disposed adjacent a front side of the main body to contact the front cover;

the paper stopper rollers are disposed at the conveying path and are connected to the front cover and are electrically connected to the one of the controllers.

2. The paper dispenser according to claim 1, wherein the holder comprises at least one slot and at least one plug adapted to be received in the at least one slot.

3. The paper dispenser according to claim 2, wherein the at least one slot and the at least one plug have a compatible shape allowing the at least one plug to fit in the at least one slot.

4. The paper dispenser according to claim 3, wherein the at least one plug comprises a first segment and a second segment, wherein the first segment is adapted for connecting to the paper roll, and wherein the second segment has the compatible shape.

* * * * *